US009574164B2

(12) United States Patent
Peltz et al.

(10) Patent No.: US 9,574,164 B2
(45) Date of Patent: Feb. 21, 2017

(54) LAUNDRY STAIN AND SOIL PRETREATMENT DEVICES

(71) Applicant: DIRTY LAUNDRY, LLC, Cleveland, OH (US)

(72) Inventors: Jamie B. Peltz, Orange Village, OH (US); Robert F. Golownia, Hudson, OH (US)

(73) Assignee: DIRTY LAUNDRY, LLC, Cleveland, OH (US)

( * ) Notice: Subject to any disclaimer, the term of this patent is extended or adjusted under 35 U.S.C. 154(b) by 115 days.

(21) Appl. No.: 14/338,793

(22) Filed: Jul. 23, 2014

(65) Prior Publication Data

US 2014/0336096 A1 Nov. 13, 2014

Related U.S. Application Data

(60) Division of application No. 13/488,066, filed on Jun. 4, 2012, now Pat. No. 8,822,399, and a continuation-in-part of application No. 13/117,813, filed on May 27, 2011, now Pat. No. 8,216,993, which is a continuation of application No. 12/545,644, filed on Aug. 21, 2009, now Pat. No. 7,973,003.

(60) Provisional application No. 61/493,667, filed on Jun. 6, 2011, provisional application No. 61/092,500, filed on Aug. 28, 2008.

(51) Int. Cl.
*C11D 17/04* (2006.01)
*C11D 17/06* (2006.01)

(52) U.S. Cl.
CPC ..... *C11D 17/042* (2013.01); *C11D 17/044* (2013.01); *C11D 17/06* (2013.01)

(58) Field of Classification Search
None
See application file for complete search history.

(56) References Cited

U.S. PATENT DOCUMENTS

| | | | |
|---|---|---|---|
| 3,645,390 | A | 2/1972 | Ryan |
| 3,953,353 | A | 4/1976 | Barrett et al. |
| 4,170,678 | A | 10/1979 | Urfer et al. |
| 4,199,482 | A | 4/1980 | Renaud et al. |
| 4,285,841 | A | 8/1981 | Barrat et al. |
| 4,348,293 | A | 9/1982 | Clarke et al. |
| 4,515,703 | A | 5/1985 | Haq |

(Continued)

FOREIGN PATENT DOCUMENTS

| | | | |
|---|---|---|---|
| EP | 0011502 | A1 | 5/1980 |
| EP | 0253566 | A2 | 1/1988 |

(Continued)

*Primary Examiner* — Lorna Douyon
(74) *Attorney, Agent, or Firm* — Pearne & Gordon LLP

(57) ABSTRACT

A laundry stain and soil pretreatment sheet including a water soluble or water dispersible carrier layer, preferably polyvinyl alcohol, a removable separator layer, and a layer of cleaning agent composition therebetween. The separator layer is removed, the composition layer is adhered to a stain on clothing, and the clothing is laundered. The carrier layer dissolves or disperses during the laundering. The separator layer can be water soluble or water dispersible. Depressions can be provided in the carrier layer to hold the layer of cleaning agent composition. Without the separator layer, a sheet of the carrier layer can be folded over to hold the cleaning agent composition.

20 Claims, 7 Drawing Sheets

(56) References Cited

U.S. PATENT DOCUMENTS 4,557,852 A 12/1985 Schulz et al.
4,595,527 A 6/1986 Gipp
4,654,395 A 3/1987 Schulz et al.
4,711,739 A 12/1987 Kandathil
4,720,351 A 1/1988 Flynn et al.
4,806,261 A 2/1989 Ciallella et al.
4,842,762 A 6/1989 Sabol, Jr. et al.
4,973,416 A 11/1990 Kennedy
5,186,856 A 2/1993 Holland
5,202,045 A 4/1993 Karpusiewicz et al.
5,288,420 A 2/1994 Mandy
5,384,060 A 1/1995 Mandy et al.
5,447,649 A 9/1995 Gormsen
5,648,326 A 7/1997 Sramek
5,747,442 A 5/1998 Bory et al.
5,780,047 A 7/1998 Kamiya et al.
5,783,541 A 7/1998 Tack et al.
5,820,637 A 10/1998 Bory et al.
5,916,674 A 6/1999 Skelly et al.
6,037,319 A 3/2000 Dickler et al.
6,077,317 A 6/2000 Murphy
6,124,036 A 9/2000 Brown et al.
6,265,368 B1 7/2001 Aronson et al.
6,465,407 B2 10/2002 Hayashi et al.
6,467,621 B1 * 10/2002 Ishida ..... A61K 9/703 206/440
6,576,604 B1 6/2003 Hoshino et al.
6,699,826 B1 3/2004 Saijo et al.
6,812,199 B2 11/2004 Dasque et al.
6,818,606 B1 11/2004 Hanada et al.
7,094,744 B1 8/2006 Kobayashi et al.
7,708,840 B2 5/2010 Wiedemann et al.
7,906,471 B2 3/2011 Wiedemann et al.
7,962,976 B2 6/2011 Peltz et al.
7,973,003 B2 7/2011 Peltz et al.
8,216,993 B2 7/2012 Peltz et al.
2002/0077266 A1 * 6/2002 Gabriel ..... A47L 25/08 510/297
2002/0192268 A1 12/2002 Alwattari et al.
2004/0072709 A1 4/2004 Wiedemann et al.
2004/0204334 A1 10/2004 Terada et al.
2004/0266650 A1 12/2004 Lambotte et al.
2005/0019277 A1 1/2005 Sagel et al.
2007/0134481 A1 * 6/2007 Aubrun-Sonneville A61K 8/0208 428/292.1
2007/0213246 A1 9/2007 Wiedemann et al.
2008/0269095 A1 * 10/2008 Aubrun-Sonneville A61K 8/0208 510/136
2010/0050344 A1 3/2010 Peltz et al.
2010/0167974 A1 7/2010 Wiedemann et al.
2010/0189770 A1 * 7/2010 Crutchley ..... A61K 9/006 424/447
2010/0272784 A1 * 10/2010 Kantner ..... A61F 13/023 424/448
2011/0035884 A1 2/2011 Peltz et al.
2011/0230382 A1 9/2011 Peltz et al.

FOREIGN PATENT DOCUMENTS

JP 2001262197 A 9/2001
JP 2002235098 A 8/2002
JP 2006335808 A 12/2006
JP 2006342273 A 12/2006
WO 0232780 A2 4/2002
WO 2010025092 A2 3/2010

* cited by examiner

LAUNDRY STAIN AND SOIL PRETREATMENT DEVICES

This application is a Division of application Ser. No. 13/488,066, filed on Jun. 4, 2012, now U.S. Pat. No. 8,822,399, which claims the benefit of U.S. Provisional Application No. 61/493,667 filed on Jun. 6, 2011, and is a Continuation-In-Part of application Ser. No. 13/117,813 filed on May 27, 2011, now U.S. Pat. No. 8,216,993, which is a Continuation of application Ser. No. 12/545,644 filed on Aug. 21, 2009, now U.S. Pat. No. 7,973,003, which claims the benefit of U.S. Provisional Application No. 61/092,500 filed on Aug. 28, 2008.

FIELD OF THE INVENTION

The invention relates to laundry stain and soil pretreatments, also called laundry prespotters, and to pretreatments which are in the form of thin self-adherent flexible sheets which can be easily applied to stained and/or soiled areas of clothing using direct finger pressure much like that used to apply adhesive tape, postage stamps, labels, decorative stickers, etc. The invention also relates to improvements thereof. The entire contents of U.S. patent application Ser. No. 13/117,813 filed May. 27, 2011 (issued as U.S. Pat. No. 8,216,993) and U.S. Provisional Patent Application No. 61/493,667 filed Jun. 6, 2011 are incorporated herein by reference.

BACKGROUND OF THE INVENTION

Liquid and semisolid compositions containing detergents and other cleaning components used as pretreatments for the stained and soiled areas of clothing prior to laundering have been available in the marketplace for many years. Examples of liquid pretreatments are described in U.S. Pat. Nos. 6,077,317 and 4,595,527. Examples of semisolid pretreatment sticks are described in U.S. Pat. Nos. 4,842,762, 5,384,060 and 5,747,442. Such pretreatments, applied to stains prior to laundering, provide extra cleaning action to a stained area on the clothing when the treated clothing is subsequently laundered in a conventional manner. The extra cleaning action provided by the invented pretreatment sheet is intended to be similar or comparable to various pretreatment products currently available in the marketplace as exemplified by "SPRAY'n WASH Stain Stick" sold by Reckitt Benckiser, Inc., Parsippany, N.J. 07054, "SHOUT LAUNDRY STAIN REMOVER" sold by S.C. Johnson & Son, Inc., Racine, Wis. 53403 and "Zout Laundry Stain Remover" sold by The Dial Corporation, Scottsdale, Ariz. which are intended to treat stains from food, oil, grass, etc. prior to laundering. The skin and eye irritation properties of laundry pretreatments are well known and are clearly acknowledged on the package labels of the widely available "SPRAY'n WASH Stain Stick", "SHOUT LAUNDRY STAIN REMOVER" and "Zout Laundry Stain Remover" pretreatment products mentioned above.

Prior art pretreatments are applied directly to stained clothing fabric by spraying liquid pretreatments or by rubbing paste or semisolid pretreatments in stick form onto the stained areas of the fabric. In the case of spray-applied liquid pretreatments, it is difficult to consistently spray an amount of liquid pretreatment just sufficient to saturate the stained areas because fabric types, depending on their thickness, weave and fiber composition (cotton, nylon, polyester, etc.) vary considerably in their ability to absorb liquids. Consequently, it is not unusual that excess liquid is sprayed onto the stain which forms pools, drips and runs of the liquid pretreatment that is not only wasteful but also increases the likelihood that the pretreatment liquid will contact and possibly irritate the user's skin during pretreatment application and when handling the pretreated clothing prior to laundering.

In the case of semisolid pretreatment sticks, the amount of pretreatment composition applied to the stained fabric will be variable because the amount of pressure applied during the application process naturally varies from person to person according to their physical strength and with their prior experience with the product. Sometimes too little pretreatment will be applied while at other times an excessive amount will be applied. As with liquid pretreatments, excess pretreatment is not only wasteful but also increases the likelihood that pretreatment will contact and possibly irritate the user's skin when handling the treated clothing prior to laundering. The present invention uses a premeasured, non-wasteful amount of cleaning agent and, due to the inclusion of the water soluble/dispersible carrier layer, reduces the possibility of skin contact with the cleaning agent and resulting skin irritation.

Thus several advantages of the invention are to provide an easy-to-use laundry stain pretreatment sheet which provides a controlled, effective but non-wasteful amount of pretreatment cleaning composition to a stained area on clothing fabric while significantly reducing the potential for the pretreatment composition to contact the skin during pretreatment application and during manual handling of the treated clothing prior to laundering. Improvements to the invention are also described and provide for simpler and more convenient application of the pretreatment sheet to stained fabric by the user and also provides a simpler pretreatment sheet design which uses fewer physical components.

SUMMARY OF THE INVENTION

A laundry stain and soil pretreatment sheet comprising a water soluble or water dispersible carrier layer, a removable separator layer, and a layer of cleaning agent composition between said carrier layer and said separator layer. A method of treating a stain on an article of clothing comprises providing a sheet as described above, removing the separator layer, adhering the layer of cleaning agent composition to the stain so that the layer of cleaning agent composition is between the stain and the carrier layer, and laundering the article of clothing, during which the carrier layer dissolves or disperses. The laundry stain and soil pretreatment sheets, articles, devices and products are also improved as follows:

The layer of cleaning agent composition can be sandwiched between and adherent to portions of the right and left sides of a single sheet of water soluble or water dispersible carrier layer which has been folded over about 180 degrees into a flattened U-shaped configuration. In use, the free non-adherent edges of the folded carrier layer opposite of the fold are manually peeled apart, using a motion similar to opening a book or magazine, to expose the cleaning agent composition layer. Subsequently, the surface of the exposed cleaning agent composition is adhered to the stained fabric or material which is subsequently laundered or washed. No separator layer as described above is used.

An improved pretreatment sheet can utilize a separator layer which is a water soluble or water dispersible film (such as described for carrier layer 14).

The water soluble or dispersible carrier layer can be improved by thermoforming one or more shallow depressions into the carrier layer film which are subsequently filled with cleaning composition and covered with a separator layer film. The depressions serve to physically confine the cleaning agent composition, especially those which are somewhat soft, to reduce or eliminate oozing or leakage of the cleaning agent composition past the edges of individual pretreatment sheets or products during storage.

Separator layers can be eliminated by using water soluble/dispersible carrier layers which have their underside treated with a release agent such that treated carrier layers with an adherent cleaning agent layer on their topside can be stacked and later peeled apart to remove a treated carrier layer with an adherent cleaning agent layer intact. The treated layer-cleaning agent layer combination is applied to stained fabric as a laundry stain pretreatment.

The cleaning agent composition can be deposited in a grid pattern, similar to postage stamps in a collector's album, onto the separator layer. Appropriately sized sheets of water soluble or dispersible carrier layer are adhered to each deposit of cleaning agent composition. Individual patches of carrier layer with adherent cleaning agent composition may be removed from the larger separator layer film leaving the other carrier layer/cleaning agent patches intact.

DETAILED DESCRIPTION OF THE PREFERRED EMBODIMENTS OF THE INVENTION

In the description that follows, when a preferred range, such as 5 to 25 (or 5-25), is given, this means preferably at least 5 and, separately and independently, preferably not more than 25. The term paste includes gel. The entire contents of all patents mentioned herein are incorporated herein by reference.

Figure 1:
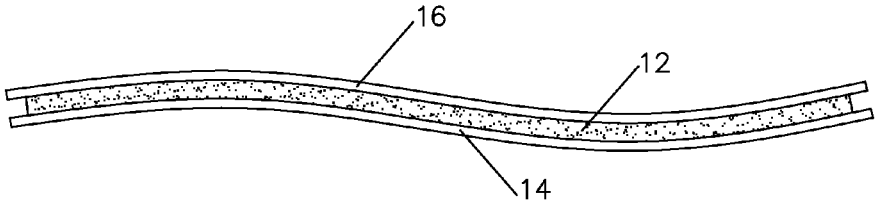
FIG. 1 is a side view of the invented pretreatment sheet showing the relative position of the three layers.

With reference to FIG. 1 there is shown a pretreatment sheet according to the invention comprising a water soluble or water dispersible carrier layer 14, a removable separator layer 16, and a layer of cleaning agent composition 12.

Carrier layer 14 is preferably flexible, such as flexible film or flexible sheet, and is water soluble at water temperatures conventionally used in residential washing machines, both cold water wash and hot water wash; alternatively, carrier layer 14 is water dispersible when used in laundering in a conventional residential washing machine at both cold water wash and hot water wash. Carrier layer 14 is preferably polyvinyl alcohol (PVA) film, less preferably other water soluble films made of or based on water soluble polymers like polyethylene oxide, partially hydrolyzed polyvinyl acetate, hydroxylethyl cellulose, hydroxylpropyl cellulose, methyl cellulose, modified starch, and others known in the art. PVA has good water solubility, good physical strength and low cost. Alternatively, carrier layer 14 can be a water dispersible layer, such as a layer of paper or similar material made of short, water-insoluble non-woven fibers, such as polyester fibers, which are designed to rapidly disintegrate or disperse when immersed in water; examples of these types of products are "Washaway Foundation Paper", W. H. Collins, Inc., Spartanburg, S.C., 29304, "Paper Solvy, Water Soluble Stabilizer", Sulky of America, Port Charlotte, Fla. 33949, and "RinsAway Water Soluble Backing", HTC, Inc., Roseland, N.J., 07068; other polyester fiber-based papers can be used. Carrier layer 14 is preferably 0.001-0.005 inches (0.025-0.13 mm) or 0.002-0.004 inches (0.051-0.1 mm), thick, less preferably 0.001-0.01 or 0.001-0.02 inches (0.025-0.25 or 0.025-0.51 mm) thick. MonoSol M8630 from MonoSol, LLC, Portage, Ind. 46368 is a commercially available PVA film that can be used. Carrier layer 14 is water soluble or water dispersible so it will dissolve/disperse when the stained clothing is laundered and will not clog filters or pipes, etc. In use, carrier layer 14 prevents (a) skin contact with the cleaning agent composition and (b) cleaning agent getting rubbed off or rubbed onto other parts of the fabric after the sheet is applied to the stained clothing and during manual and mechanical handling prior to the clothing being laundered.

Separator layer 16 is used to prevent cleaning agent composition 12 from coming into contact with and adhering to other pretreatment sheets or other things during manufacturing, packaging, handling and storage. Layer 16 is impervious to composition 12 and is easily peeled and released from the surface of composition 12 immediately prior to application of the pretreatment sheet to the stained clothing fabric. Layer 16 is preferably polyethylene film, such as is used to make food storage bags for home use, less preferably other flexible plastic or polymer films (polyester, polyvinyl chloride, etc.). Layer 16 is preferably about 0.001-0.004 inches (0.025-0.1 mm) or 0.003 inches (0.076 mm) thick, less preferably 0.001-0.01 inches (0.025-0.25 mm) thick. Release liners or release strips as known in the art, including those having a silicone release layer, can also be used.

Cleaning agent composition 12 is a composition which is effective to treat or clean stained or soiled clothing or fabric in a manner preferably similar to conventional laundry stain and soil pretreatments or pre-spotters. Cleaning agent composition 12 is preferably flexible and bendable so it can bend or flex with the clothing to which it is stuck. Composition 12 must be sufficiently sticky so that it will effectively adhere to stained or soiled clothing, such as cotton jeans, polyester jeans, clothing made of linen, jersey, khaki, wool, rayon, nylon, cotton blends, polyester blends, etc., during handling prior to washing and during a washing cycle in a residential washing machine, when pressed on with finger pressure. Preferably, composition 12 is sticky enough that, during a wash cycle in a residential washing machine, it will dissolve off of the clothing fabric, rather than fall off. Preferably, composition 12 will adhere to the clothing fabrics mentioned above at least as well as peanut butter, alternatively at least as well as a pad of butter at 40, 45, 50, 55 or 60° F. Composition 12 is preferably a paste, preferably a thick or viscous paste or stiff paste, preferably stiffer than grocery store peanut butter; it can be almost stiff enough that it shows cracks when bent; it can have a stiffness comparable to or less than the stiffness of a pad of butter at 40, 45, 50, 55 or 60° F.

Composition 12 contains surfactants, detergents, enzymes, chelating agents and/or other agents known in the art so that composition 12 can work effectively. In order to form a paste or make it thicker, composition 12 can preferably contain one or more water soluble or water dispersible thickening agents, such as polyethylene oxide, hydroxyethyl cellulose, hydroxypropyl cellulose, fumed silica, natural gums such as guar gum, and others known in the art.

Since carrier layer 14 is water soluble/dispersible, it is preferred to minimize the amount of water in composition 12 to prevent or minimize softening or wrinkling or dissolution of layer 14 during storage. Composition 12 is preferably less than 24, 23, 22, 21, 20, 19, 18, 17, 16, 15, 14, 13, 12, 11, 10, 9, 8, 7, 6, 5, 4, 3, 2, 1, 0.5, 0.3, 0.2, 0.1, or 0.01, weight percent water or unbound water. Some water may need to be added to accommodate added enzymes or other additives or to modify viscosity or for other reasons in composition 12. Water in composition 12 can be minimized or neutralized by being bound or complexed with other molecules; or other agents with an affinity for water can be added, such as alkanolamine, such as monoethanolamine, diethanolamine, triethanolamine and mixtures thereof, to protect layer 14 from water. Any water in composition 12 should be less than an amount which would prevent layer 14 from functioning effectively as a carrier layer. Composition 12 should be essentially water-free, meaning that any water in composition 12 should be less than an amount which would prevent layer 14 from functioning effectively as a carrier layer.

Composition 12 preferably contains at least 50, 55, 60, 65, 70, 75, 80, 85, 90, 91, 92, 93, 94, 95, 96, 97, 98, 99, 99.5 or 100, weight percent surfactant as known in the cleaning art. Composition 12 preferably contains less than 40, 35, 30, 25, 20, 15, 10, 8, 5, 4, 3, 2 or 1, weight percent thickener and preferably less than 10, 9, 8, 7, 6, 5, 4, 3, 2, 1, 0.8, 0.5, 0.3, 0.2, 0.1 or 0.01, weight percent enzyme, but can contain at least 0.01 or 0.1 weight percent thickener or enzyme. Weight percents of components are calculated as received from the supplier, that is, including the water or solvent or carrier that the component is in.

U.S. Pat. Nos. 4,973,416 and 6,037,319 describe liquid cleaning agent compositions which contain up to about 24 weight percent water which can be stored in PVA pouches; these compositions can be used, but they have to be turned into a paste such as by the addition of a thickener and/or the inclusion of solid and/or paste surfactants and/or water soluble waxy solids, for example those surfactants and waxy solids described in U.S. Pat. No. 3,953,353. Examples of useful cleaning agent compositions include, but are not limited to, those described in U.S. Pat. 3,953,353, which optionally can be adjusted to make them sticky and a paste. Similar cleaning agent compositions can also be used. Cleaning agent composition 12 is preferably essentially anhydrous. Composition 12 can, for example, contain 0.1-50 or 1-40 or 10-35 or 20-32 or 25-35 wt. % polyethylene oxide or any surfactant, preferably MW 2000-6000 or 3500-4500 g/mol, melting point 45-65 or 50-60° C. Composition 12 preferably contains solid or paste surfactants (such as EO/PO block copolymer) preferably MW of 2000-10000 or 3000-9000 or 4000-7000 or 4000-6000 g/mol. Alternatively, composition 12 can be essentially soap-free.

Preferred surfactants include those mentioned in the Examples herein or in the same class, as well as the same surfactants with as much as ±10% or ±20% as to molecular weight and melting point; they can be present in the same weight percent as in the Examples or up to ±10%, 20%, 30%, 40% or 50% as to weight percent or molecular weight or melting point.

A cleaning agent composition 12 can be prepared by melting together at about 150-200° F. a blend of surfactants, detergents, enzymes, chelating agents, thickeners, etc. and other components, chosen to optimize the melting point, hardness, cleaning efficacy and adhesive properties, and preferably becomes a paste upon cooling to room temperature.

EXAMPLES

The materials listed in Examples below were mixed and melted together while stirring with a metal spatula in a stainless steel container resting on an electric hotplate which was adjusted to bring the temperature of the melt to approximately 165° F. in about five minutes. The melt was then poured onto a 0.003 inch (0.076 mm) thick film of PVA film (MonoSol M8630 from MonoSol, LLC, Portage, IN 46368) resting on a flat horizontal surface. The melt was then immediately spread out onto the PVA film with a single sweeping motion of a warm, 0.025 inches (0.64 mm) thick, steel doctor blade which was spaced above the PVA film by 0.5 inch (12.7 mm) wide by 10 inches (254 mm) long by 0.018 inch (0.46 mm) thick plastic shims resting on the upper surface of the PVA film. When cooled to room temperature, the mixture became a waxy paste which, over time, did not cause softening, wrinkling or puckering of the PVA water soluble layer 14. At this time, a separator layer of 0.001 inch thick polyethylene was placed on the top surface of the cleaning agent composition layer. The cleaning agent composition is preferably 0.1-5 or 0.2-3 or 0.3-2 or 0.3-1 or 0.3-0.6 mm thick on the layer 14. The invented sheet and the layer 14 is preferably provided in small squares, rectangles, circles or other shapes, preferably not more than 1, 2, 3, 4, 5, 6, or 7 inches (25, 51, 76, 102, 127, 152 or 178 mm) in its longest dimension, such as circles not more than 0.5, 1, 2, 3, 4, 5, 6 or 7 inches (13, 25, 51, 76, 102, 127, 152 or 178 mm) in diameter, or squares or rectangles having sides not more than 0.5, 1, 2, 3, 4, 5, 6 or 7 inches (13, 25, 51, 76, 102, 127, 152 or 178 mm) in length. The cleaning agent composition is preferably separated from the edge of the layer 14 by a distance of at least or not more than 1, 2, 3, 4, 5, 6, 7, 8, 9, 10, 11, 12, 13, 14 or 15 mm.

EXAMPLES OF CLEANING AGENT COMPOSITIONS

Example 1

| | Parts by weight |
|---|---|
| Pluriol E-4000* (polyethylene oxide waxy solid, MW = 4,000 g/mol, MP = 55° C.) | 30 |
| Pluronic P-84* (semisolid EO/PO block copolymer surfactant, MW = 4,200 g/mol) | 41 |
| Lutensol TDA-3* (liquid surfactant, tridecyl alcohol + 3 moles ethylene oxide) | 29 |

*Supplied by BASF Corporation, Mount Olive, NJ 07628

Example 2

| | Parts by weight |
|---|---|
| Lutensol AT-25* (solid surfactant, stearyl alcohol + 12 moles ethylene oxide) | 30 |
| Pluronic P-84* (semisolid EO/PO block copolymer surfactant, MW = 4,200 g/mol) | 40 |
| Lutensol TDA-3* (liquid surfactant, tridecyl alcohol + 3 moles ethylene oxide) | 30 |

*Supplied by BASF Corporation, Mount Olive, NJ 07628

Example 3

| | Parts by weight |
|---|---|
| Pluronic F-87* (solid EO/PO block copolymer surfactant, MW = 7700 g/m) | 29 |
| Pluronic P-84* (semisolid EO/PO block copolymer surfactant, MW = 4,200 g/mol) | 40 |
| Lutensol TDA-3* (nonionic surfactant, tridecyl alcohol + 3 moles ethylene oxide) | 29 |
| Purastar HP Am 5000L** (proprietary aqueous solution of alpha amylase enzyme) | 1 |
| Purafect Prime 4000L** (proprietary aqueous solution of proteolytic enzyme) | 1 |

*Supplied by BASF Corporation, Mount Olive, NJ 07628
**Supplied by Genencor International, Rochester, NY 14618

Example 4

| | Parts by weight |
|---|---|
| Pluronic F-87* (solid EO/PO block copolymer surfactant, MW = 7700 g/m) | 30 |
| Pluronic P-84* (semisolid EO/PO block copolymer surfactant, MW = 4,200 g/mol) | 40 |
| Lutensol TDA-3* (liquid surfactant, tridecyl alcohol + 3 moles ethylene oxide) | 10 |
| Pluronic L-64* (liquid EO/PO block copolymer surfactant, MW = 2900 g/m) | 20 |

*Supplied by BASF Corporation, Mount Olive, NJ 07628

Using the process described above, the composition of Example 1 was formed into pretreatment sheets of 19 mm by 19 mm squares which were subsequently applied to 100% cotton knit t-shirt fabric which had been previously stained with dyed (4% ground yellow Annato seed added) vegetable cooking oil, French-style salad dressing and tomato ketchup. Stains were 19 mm diameter circles made by applying 0.1 milliliter of stain material to the fabric and allowing to dry for twelve hours before testing. One pretreatment sheet was applied to each stain and allowed to remain in contact for two hours before laundering in a Whirlpool Model VVTW5700W0 home washing machine set for cold water wash and using "2×Ultra Tide" liquid laundry detergent in conventional amount. The test fabrics were laundered and dried in conventional manner. Visual inspection of the laundered and dried test fabrics showed that the stained areas which were treated with the pretreatment sheets of Example 1 were noticeably lighter in color than corresponding stained areas which had no pretreatment sheet applied prior to laundering.

The separator layer 16 is applied with slight pressure to the top surface of the cooled and solidified layer of cleaning agent composition 12 before further processing and packaging of the completed pretreatment sheets. Further processing can include operations like cutting of the sheet into smaller sizes to suit consumer needs, printing of quality control information, logos, directions, etc. onto the exposed surfaces of the layer 14 and/or the separator layer 16. The separator layer may be colored or printed to make it visually obvious to the user that it is to be removed and discarded before application of the cleaning agent-carrier layer combination to the stained clothing fabric.

Figure 2:
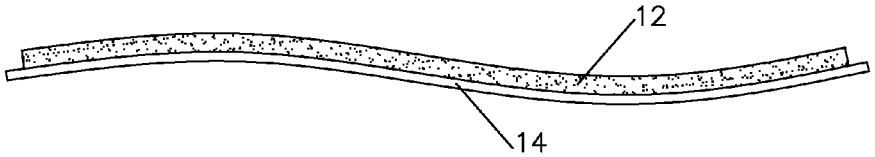
FIG. 2 is a side view of the pretreatment sheet shown in FIG. 1 with the separator layer removed.
Figure 3:
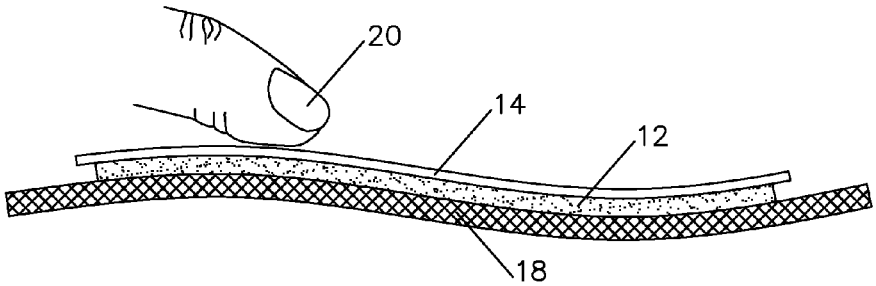
FIG. 3 is a side view of the pretreatment sheet, with the separator layer removed, being adhered to stained fabric using finger pressure applied to the sheet.
Figure 4:
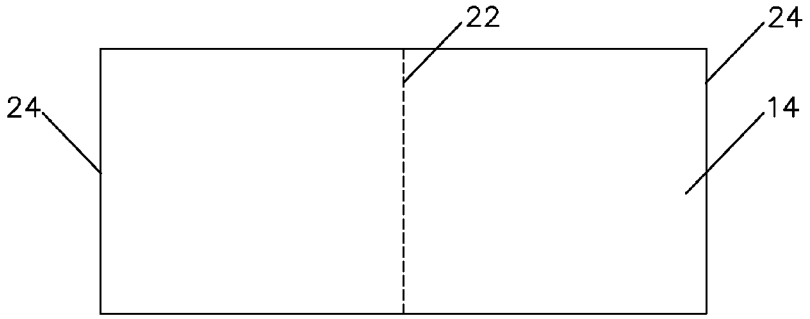
FIG. 4 is a top view of a water soluble/dispersible carrier layer showing the fold line and identifies the water soluble/dispersible carrier layer edges parallel to the fold line.
Figure 5:
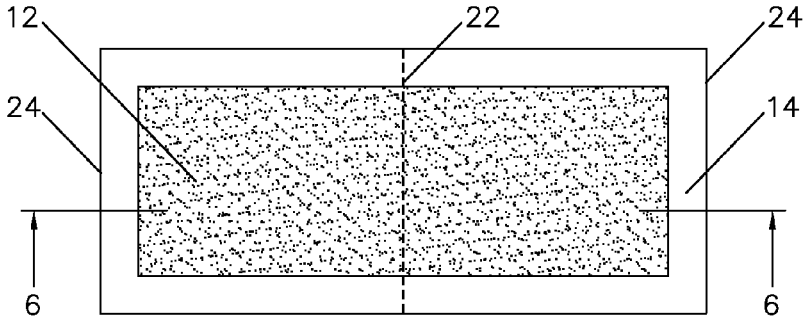
FIG. 5 is a top view of the water soluble/dispersible carrier layer showing the fold line and a layer of cleaning agent composition deposited onto a central portion of the water soluble/dispersible carrier layer.
Figure 6:
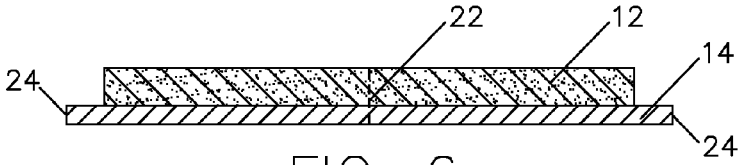
FIG. 6 is a cross-sectional side view taken along line 6-6 of FIG. 5.

In operation one removes a stain pretreatment sheet from the package and, using the fingers, grasps the edge of the separator layer 16 and peels it away from the surface of the cleaning agent composition 12 while holding the edge of the carrier layer between the fingers of the other hand. This process leaves the cleaning agent-carrier layer combination intact as shown in FIG. 2. The cleaning agent-carrier layer combination is then positioned above the stained portion of the fabric and pressed onto the stain with finger 20 pressure (or it can be pressed with a hand tool such as the end of a pen or a small piece of plastic so as to prevent cleaning agent from contacting the finger 20) with sufficient force to cause the cleaning agent-carrier layer combination to adhere to the stained clothing fabric 18. The invention can be stuck to the stain as soon as the stain is noticed and left in place for one to several days or a week or longer before the fabric is laundered; alternatively it can be stuck on right before the fabric is laundered. Unlike prior art liquid and stain stick type laundry stain pretreatments, the carrier layer of the pretreatment sheet remains adhered to the cleaning agent after application to the stain where it functions as a barrier to prevent contact of the cleaning agent with the skin during pretreatment application and during subsequent manual handling of the pretreated clothing prior to laundering. The pretreated stained fabric can now be laundered by conventional means in home or commercial washing machines. For example, the stained fabric with the invented sheet stuck to it can be put into a washing machine with or without other clothes; a conventional detergent in a conventional amount for all the clothes in the load can be added; water is added; the washing machine agitates the clothes in the water; the water is removed; the clothes are rinsed and then dried. Alternatively, the stained fabric treated with the invention can be laundered in the same manner as stained fabrics pretreated with prior art pretreatments or stain removers are laundered. Because it is adhered directly to the stain, the pretreatment sheet will supply concentrated cleaning action to the stained area during laundering to give a level of stain removal superior to non-pretreated areas of the clothing. Because the carrier layer is water soluble/dispersible, it harmlessly dissipates into the wash water during the laundering process.

Unless otherwise mentioned or apparent, the features, elements, components, compositions, measurements, dimensions, etc. mentioned below are the same or similar to the corresponding features, elements, components, compositions, measurements, dimensions, etc. set forth above.

Figure 7:
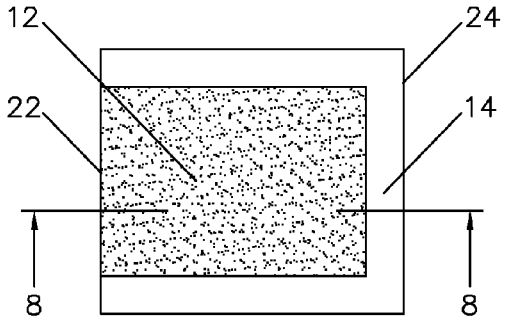
FIG. 7 is a top view of the device of FIG. 5 which has been folded on the fold line, about 180 degrees, left to right, to sandwich the cleaning agent composition between the right and left halves of the water soluble/dispersible carrier layer. To facilitate understanding, composition 12 is shown as visible.
Figure 8:
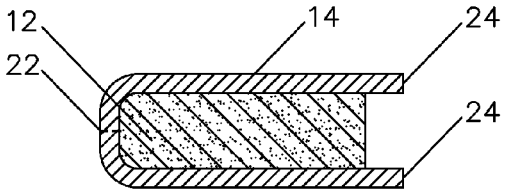
FIG. 8 is a cross-sectional side view taken along line 8-8 of FIG. 7.
Figure 9:
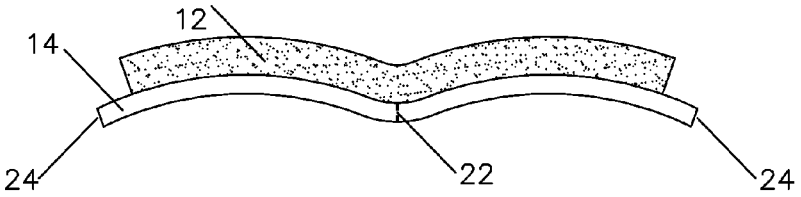
FIG. 9 is a non-cross-sectional side view and is like FIG. 8 after the device of FIG. 8 has been unfolded by pulling apart the edges of the water soluble/dispersible carrier layer which are parallel to and opposite of the fold line.
Figure 10:
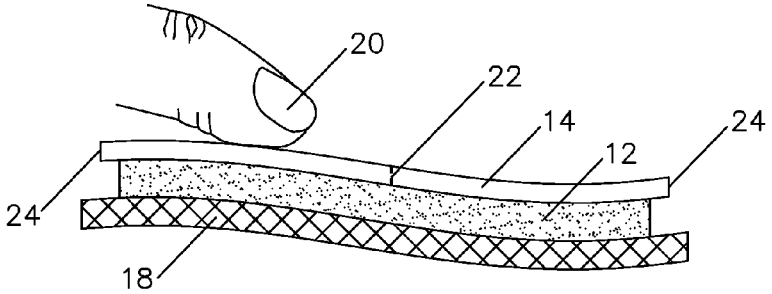
FIG. 10 is a side view of the unfolded pretreatment device of FIG. 9 being adhered to stained fabric using finger pressure applied to the carrier layer side of the sheet.
Figure 11:
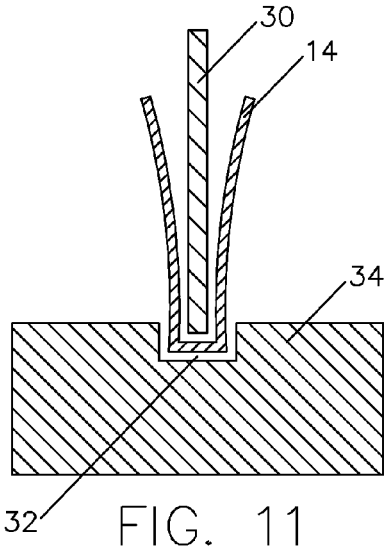
FIG. 11 is a cross-sectional schematic side view of PVA film being folded by using a heated steel sheet punch to force a small portion of the PVA film into a narrow slot.
Figure 12:
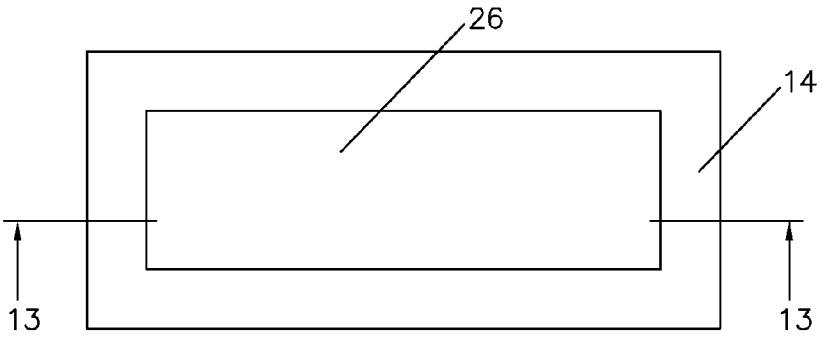
FIG. 12 is a top view of a thermoformed sheet of water soluble/dispersible carrier sheet having a centrally located depression.
Figure 13:
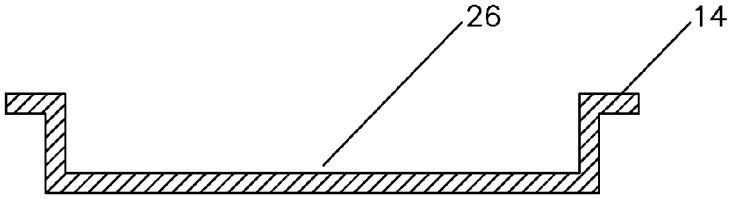
FIG. 13 is a cross-sectional side view taken along line 13-13 of FIG. 12.

With reference to FIGS. 4-11 and 18-21, the first of the improvements of the invention comprises modifying the physical construction of the pretreatment sheet or device in order to eliminate the separator layer 16. This is accomplished by employing a single sheet of water soluble/dispersible carrier layer 14 (FIG. 4) which when folded about 180 degrees on the fold line 22 such that when the edges 24 of the water soluble/dispersible carrier layer parallel to the fold line 22 are brought together, the cleaning agent composition 12 already deposited on the carrier 14 as in FIGS. 5-6 will be sandwiched between the right and left hand portions of the carrier sheet 14 of FIG. 4. As shown in the Figs., the carrier layer 14 has a first portion and a second portion divided (preferably in half) by a fold area (FIG. 8) or line 22; the first portion being folded over the second portion along the fold area or line. FIGS. 7-8 show the top and side cross-sectional views respectively of the completed improved folded pretreatment sheet. In use, the edges 24 of the folded pretreatment sheet are grasped with the fingers of the right and left hands and the folded pretreatment sheet is peeled open using a motion similar to opening a book or magazine. Once open, the cleaning agent 12 side of the pretreatment sheet is applied to a stained fabric 18 using finger 20 pressure as shown in FIG. 10. Because the separator layer 16 is eliminated, the raw material cost of the pretreatment sheet is reduced and end use application is simplified by elimination of the need to remove and dispose of the separator layer.

In one embodiment of this particular improvement, a sheet of polyvinyl alcohol (PVA) film 14 measuring 0.003×2.00×2.75 inches was folded along a fold line 1.25 inches from and parallel to one of the 2.00 inch edges by forcing the film (FIG. 11) along the fold line into a 3 inch long slot 32 measuring 0.020 inches deep by 0.040 inches wide, cut into a wood block 34 by using a flat steel sheet tool 30 measuring 0.032×3×3 inches heated to 130 C. After about 2 seconds, the steel sheet 30 was withdrawn and the folded PVA sheet 14 removed from the slot. A permanent crease had been thermoformed in place along the fold line 22. The folded PVA sheet 14 was held flat and a melted cleaning agent composition 12 consisting of Pluronic L-64, 67 parts by weight and Pluronic P-105, 33 parts by weight was spread over the central portion of the creased PVA sheet 14 to a thickness of about 0.020 inches. (Pluronic surfactants supplied by BASF Corp., Mt. Olive, N.J. 07828) After several minutes, the molten Pluronic surfactant cleaning composition mixture had solidified and the coated sheet 14 was folded along the thermoformed crease to bring the exposed right and left hand surfaces of the cleaning agent composition 12 into direct contact with each other. The adhesion between the contacting cleaning agent composition 12 surfaces was sufficient to hold the entire pretreatment sheet in a folded configuration as in FIG. 8 until manually pulled open as in FIG. 9.

Figure 16:
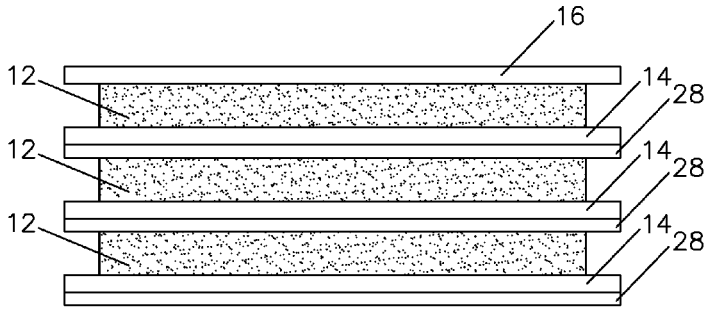
FIG. 16 is a side view of a stack of pretreatment sheets/devices made up of water soluble/dispersible carrier layers which have been treated with release agent on their underside alternating with layers of cleaning agent composition. A single separator layer covers the topmost layer of cleaning agent composition.
Figure 18:
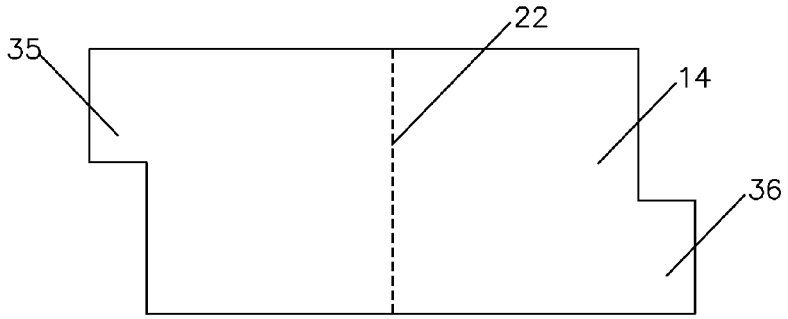
FIG. 18 is a top view of a water soluble/dispersible carrier layer showing the fold line and tabs cut into the water soluble/dispersible carrier layer edge areas parallel to the fold line.
Figure 19:
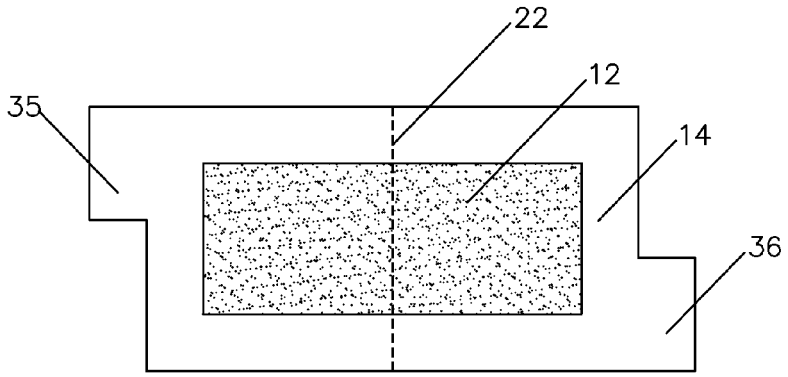
FIG. 19 is a top view of the water soluble/dispersible carrier layer of FIG. 18 showing the fold line, tabs and a layer of cleaning agent composition deposited onto a central portion of the water soluble/dispersible carrier layer.
Figure 20:
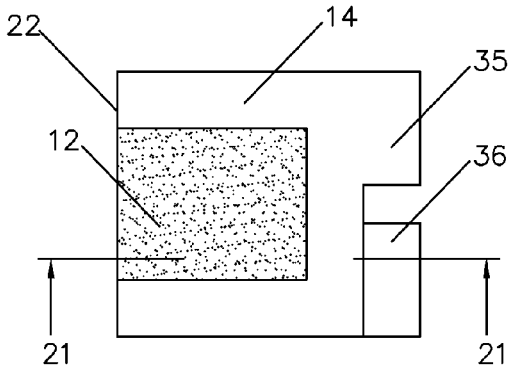
FIG. 20 is the device of FIG. 19 which has been folded on the fold line, about 180 degrees, left to right, to sandwich the cleaning agent composition between the right and left halves of the water soluble/dispersible carrier layer. To facilitate understanding, composition 12 is shown as visible.
Figure 21:
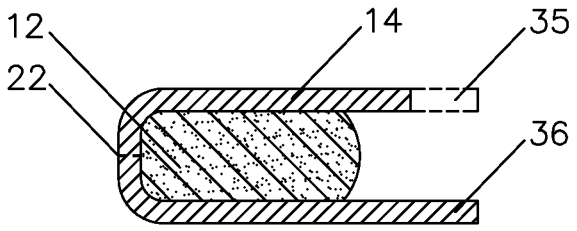
FIG. 21 is a cross-sectional side view taken along line 21-21 of FIG. 20.

The geometrical shape of the water soluble/dispersible carrier layer 14 may be modified as shown in FIG. 18 to create tabs 35 and 36 which simplify the process of pulling open the folded pretreatment sheet. As shown in FIG. 16, a first tab 35 extends from an edge of a first portion of the carrier layer 14 opposite the fold area or line; a second tab 36 extends from an edge of a second portion opposite the fold area or line. A layer of cleaning agent mixture 12 is deposited on the water soluble/dispersible carrier layer 14 as shown in FIG. 19. After the cleaning agent composition 12 has adequately solidified, the water soluble/dispersible carrier sheet 14 with its deposit of cleaning agent composition 12 of FIG. 19 is folded about 180 degrees along the fold line 22 to bring the exposed right and left hand surfaces of the cleaning agent composition 12 into direct contact with each other. The adhesion between the contacting cleaning agent composition 12 surfaces is sufficient to hold the entire sheet in a folded configuration as shown in FIGS. 20 and 21 until manually pulled apart by grasping tab 35 between the thumb and index finger of one hand while simultaneously grasping tab 36 between the thumb and index finger of the other hand and subsequently pulling tabs 35 and 36 apart from each other in a direction normal to the outside surfaces of the folded water soluble/dispersible carrier layer 14. The tabs 35, 36 eliminate the need to locate and pry apart the edges 24 of the folded pretreatment sheet of FIGS. 7-8 prior to griping them individually with the fingers. The tabs can be of various shapes and number to suit user, packaging and/or manufacturing needs; for example, they can be partially or completely overlapping, or non-overlappingly offset.

The second of the improvements of the invention utilizes the invented sheet of FIG. 1, except that the removable separator layer 16 (corresponding to separator layer 16 herein) is a water soluble or water dispersible film (such as described for carrier layer 14) which, after removal from the cleaning composition layer 12, may be simply disposed of by placing into the same storage container (laundry hamper, etc.) or washing machine as is the stained clothing. During laundering, the water soluble or dispersible removable separator layer 16 harmlessly dissolves into the wash water. There is no need to dispose of the water soluble/dispersible separator layer 16 into a trash container. This water soluble or water dispersible separator layer 16 can be substituted for any separator layer 16 described in this patent application. To improve the release of the water soluble/dispersible separator layer 16 from the cleaning agent layer 12, the separator layer 16 may be treated with a thin layer of release agent of wax, silicone or other release agent material known to those skilled in the art before contacting the cleaning agent composition layer 12.

Figure 14:
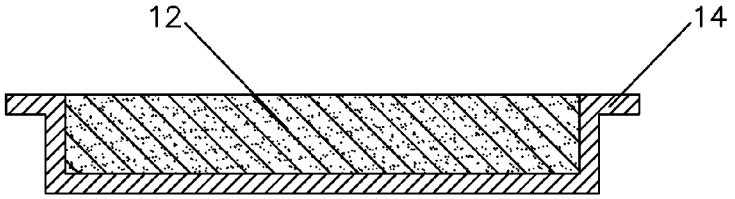
FIG. 14 is like FIG. 13 but also with the centrally located depression filled with cleaning agent composition.
Figure 15:
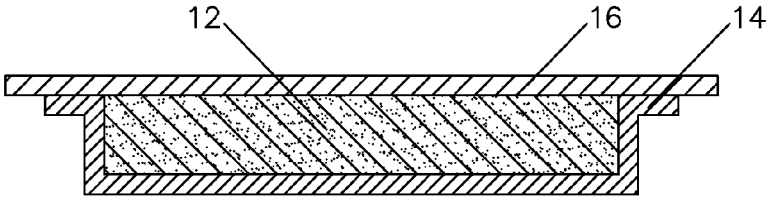
FIG. 15 is like FIG. 14 with the addition of a separator layer adhered to the surface of the cleaning agent composition.

With reference to FIGS. 12-15, the third of the improvements of the invention comprises a water soluble/dispersible carrier layer 14 which has been formed (for example by thermoforming at 130 C) to have a centrally located depression 26, about 0.005-0.25 or 0.01-0.2 or 0.03-0.18 or 0.05-0.15 or 0.08-0.12 or about 0.1, inches deep (or a plurality of such depressions in a larger sheet of carrier layer 14, with each depression section of layer 14 being surrounded by perforations or tear lines so it can be torn away), into which the cleaning agent composition 12 is deposited as in FIG. 14. The length, width and depth of the depression is preferably the length, width and thickness of cleaning agent composition 12 or the length and width of carrier layer 14 as described above; alternatively the depth is preferably at least, and not more than, 0.1, 0.2, 0.5, 0.8, 1, 2, 3, 4, 5, 6, 7 or 8, mm. The separator layer 16 is adhered to the top surface of the cleaning agent composition layer 12 as in FIG. 15 to complete the improved pretreatment sheet construction. The perimeter of separator layer 16 can be releasably sealed to the exposed perimeter of carrier layer 14 (see FIG. 15) as known in the art, such as via heat sealing, adhesive, etc. Separator layer 16 preferably releasably sticks to layer 12. Partially enclosing the cleaning agent composition layer within the depression eliminates or reduces the tendency for oozing or leakage of the cleaning agent composition 12 layer past the edges of the individual pretreatment sheets during storage thusly improving pretreatment sheet storage stability especially at higher temperatures which could soften the cleaning composition 12 to facilitate unwanted oozing and leakage.

With reference to FIG. 16, the fourth of the improvements of the invention, there is shown a stack of laundry stain and soil pretreatment sheets like those described above. The stack includes at least or not more than 2, 3, 4, 5, 6, 7, 8, 9, 10, 11, 12 or more sheets adhered to each other, one atop the other as shown. Each sheet includes a water soluble or dispersible carrier layer 14 of FIG. 1, the underside of which is treated with a release agent 28 of silicone oil, wax, fluorocarbon polymer powder etc. to reduce the adhesion of the treated underside of the carrier layer 14+28 to the cleaning agent layer 12 immediately below said treated carrier layer 14+28. When such treated sheets of carrier layer 14, having a layer of cleaning agent 12 on the central portion of the untreated top surface, are stacked one upon another as shown in FIG. 16, the bottommost treated carrier sheet 14+28 with its adherent top layer of cleaning agent composition 12 may be peeled away from the overlying carrier layer 14 by virtue of the intervening coating of release agent (silicone, wax, etc.) 28 and is applied to stained fabric as a laundry stain pretreatment as in FIG. 10. In other words, in FIG. 16, you peel from the bottom, one after the other, the carrier layer 14 having adhered to its top surface the composition layer 12. Each sheet comprises a carrier layer having a first surface and a second surface as shown, a layer of cleaning agent composition 12 is adhering to the first or top surface; a layer of release agent 28 is adhering to the second or bottom surface. The separator layer 16 is largely eliminated because it is not required for any but the topmost layer of cleaning agent composition in the stacked array (see layer 16 adhering to the layer 12 of the top sheet in the stack). Furthermore, the stacked pretreatment sheets take up less space than stacked sheets having individual separator layers associated with each pretreatment sheet.

Figure 17:
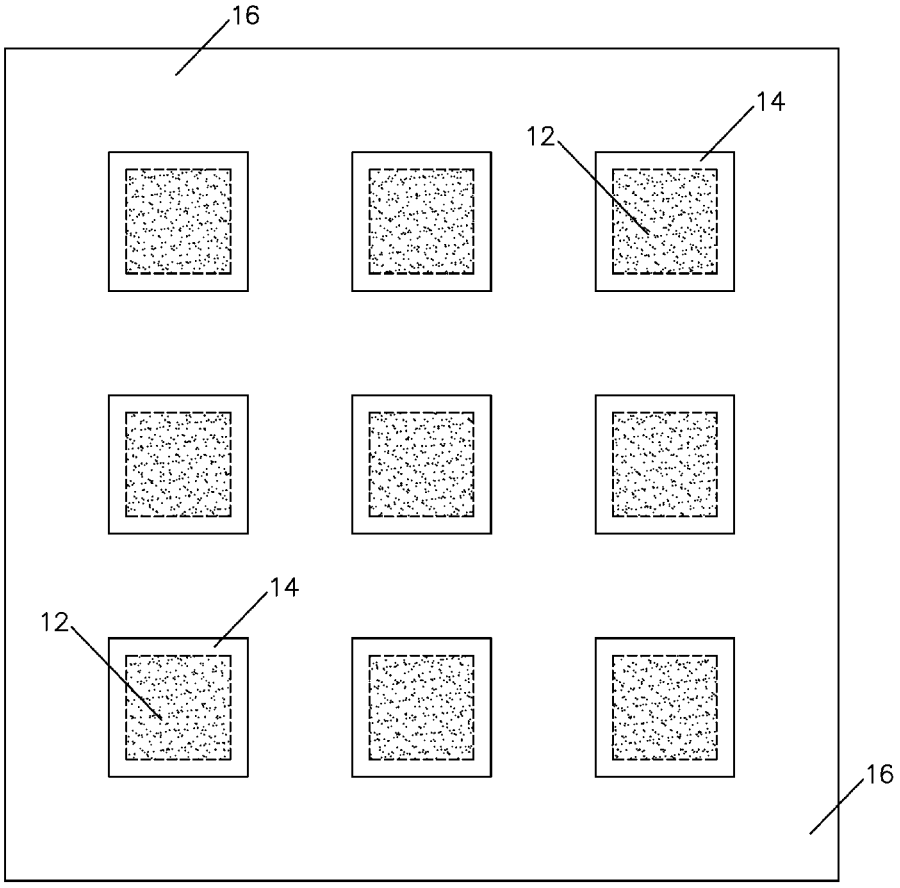
FIG. 17 is a top view of a relatively large single separator layer onto which a plurality of smaller individual patches of cleaning agent composition have been deposited which are covered with slightly larger individual sheets of water soluble/dispersible carrier layer.

With reference to FIG. 17, the fifth of the improvements of the invention, there is shown an article comprising a separator layer sheet 16 having adhered to a first or top surface thereof a plurality (at least or not more than 2, 3, 4, 6, 8, 10, 15, 20, 25, 30 or more) of patches of cleaning agent composition 12 (dimensions described above), each patch of cleaning agent composition 12 being covered by an individual patch of water soluble or water dispersible carrier layer 14 (dimensions described above). The patches can also be on the second or back surface of sheet 16. The article utilizes patches of cleaning agent composition 12 deposited in a grid pattern, similar to postage stamps in a collector's album, onto the separator layer 16 described above. Appropriately sized sheets or patches of water soluble/dispersible carrier layer 14 are adhered to and cover each patch or deposit of cleaning agent composition 12. Individual patches of carrier layer 14 with adherent cleaning agent composition 12 may be removed or peeled from the larger separator layer 16 film leaving the other carrier layer/cleaning agent patches intact. The combination of cleaning agent composition 12 patches and their associated water soluble/dispersible layers 14 may be of different sizes and/or shapes. The larger separator layer 16 may be at least or not more than 5, 6, 7, 8, 9, 10, 11, 12, 13 or 14 inches long by at least or not more than 5, 6, 7, 8, 9, 10, 11 or 12 inches wide; the patches of composition 12 and carrier layer 14 can have a length, width and thickness as described above, preferably at least or not more than 0.5, 1, 1.5, 2, 2.5, 3, 4 or 5 inches wide and long. Because multiple pretreatment patches or sheets are attached to a single separator layer, the pretreatment sheets/patches stay organized in a pattern which simplifies removal of the separator sheet and packaging requirements. Furthermore, the invented improvements and/or features described herein can be combined or incorporated into a single sheet or article or device or product or method.

Although the herein above described embodiments of the invention constitute the preferred embodiments, it should be understood that modifications can be made thereto without departing from the scope of the invention as set forth in the appended claims.

What is claimed is:

1. An article comprising a separator layer sheet having adhered to a first surface thereof a plurality of patches of cleaning agent composition, each patch of cleaning agent composition being covered by an individual patch of water soluble or water dispersible carrier layer, the cleaning agent composition of each patch directly contacting the first surface, each patch of cleaning agent composition being effective to treat a stained or soiled area of a fabric, the separator layer sheet being peelable and releasable from each patch of cleaning agent composition, wherein said cleaning agent composition comprises at least 50 weight percent surfactant.

2. The article of claim 1, wherein the separator layer sheet has adhered to the first surface thereof at least 30 patches of cleaning agent composition.

3. The article of claim 1, wherein the separator layer sheet is at least 14 inches long.

4. The article of claim 1, wherein the separator layer sheet is not more than 5 inches wide.

5. The article of claim 3, wherein the separator layer sheet is not more than 5 inches wide.

6. The article of claim 1, wherein each patch of cleaning agent composition is not more than 3 inches long and not more than 2.5 inches wide.

7. The article of claim 1, wherein each patch of carrier layer is not more than 4 inches long and not more than 3 inches wide.

8. The article of claim 2, wherein the separator layer sheet is at least 14 inches long and not more than 5 inches wide.

9. The article of claim 1, wherein said carrier layer is a water soluble film.

10. The article of claim 1, wherein the cleaning agent composition is a paste.

11. The article of claim 1, wherein said cleaning agent composition comprises less than 24 weight percent water.

12. The article of claim 1, wherein said cleaning agent composition comprises less than 10 weight percent water.

13. The article of claim 1, wherein each patch of cleaning agent composition is 0.1-5 mm thick.

14. The article of claim 1, wherein said cleaning agent composition is sufficiently sticky so that it will effectively adhere to a stained or soiled fabric when pressed on with finger pressure.

15. The article of claim 1, wherein said cleaning agent composition is essentially anhydrous.

16. The article of claim 1, wherein said cleaning agent composition comprises at least 10 weight percent polyethylene oxide surfactant.

17. The article of claim 1, wherein said cleaning agent composition comprises at least 85 weight percent surfactant.

18. The article of claim 1, wherein said carrier layer is polyvinyl alcohol film.

19. The article of claim 1, wherein said carrier layer adheres to said cleaning agent composition by the stickiness of the cleaning agent composition.

20. The article of claim 1, wherein said separator layer sheet comprises polymer film.

* * * * *